United States Patent [19]

Oldfelt

[11] 4,246,925

[45] Jan. 27, 1981

[54] WASTE WATER VACUUM CONVEYANCE METHOD AND APPARATUS

[75] Inventor: Sven Oldfelt, Stockholm, Sweden

[73] Assignee: Aktiebolaget Electrolux, Stockholm, Sweden

[21] Appl. No.: 969,063

[22] Filed: Dec. 13, 1978

[30] Foreign Application Priority Data

Dec. 14, 1977 [SE] Sweden ..... 7714199

[51] Int. Cl.[3] ..... E03D 1/00

[52] U.S. Cl. ..... 137/205; 137/236 R; 4/300; 4/431

[58] Field of Search ..... 137/205, 236, 255; 4/431, 300, 198, 427

[56] References Cited

U.S. PATENT DOCUMENTS

| | | | |
|---|---|---|---|
| 3,002,523 | 10/1961 | Rabbitts | 137/205 |
| 4,120,312 | 10/1978 | Michael | 137/205 X |

*Primary Examiner*—Alan Cohan

*Attorney, Agent, or Firm*—Alfred E. Miller

[57] ABSTRACT

A sanitary installation in which waste water is conveyed to a pipe system during the simultaneous supply of air. The pipe system includes a generally vertical long length of pipe which is closed at its upper end and open at its lower end. Waste water and air is introduced in the upper part of the pipe whereby air is separated and removed by means of a vacuum pump connected to the upper part of the pipe. Waste water is further collected in the form of a standing liquid column in the lower part of the vertical pipe and is successively caused to flow to a holding tank.

3 Claims, 1 Drawing Figure

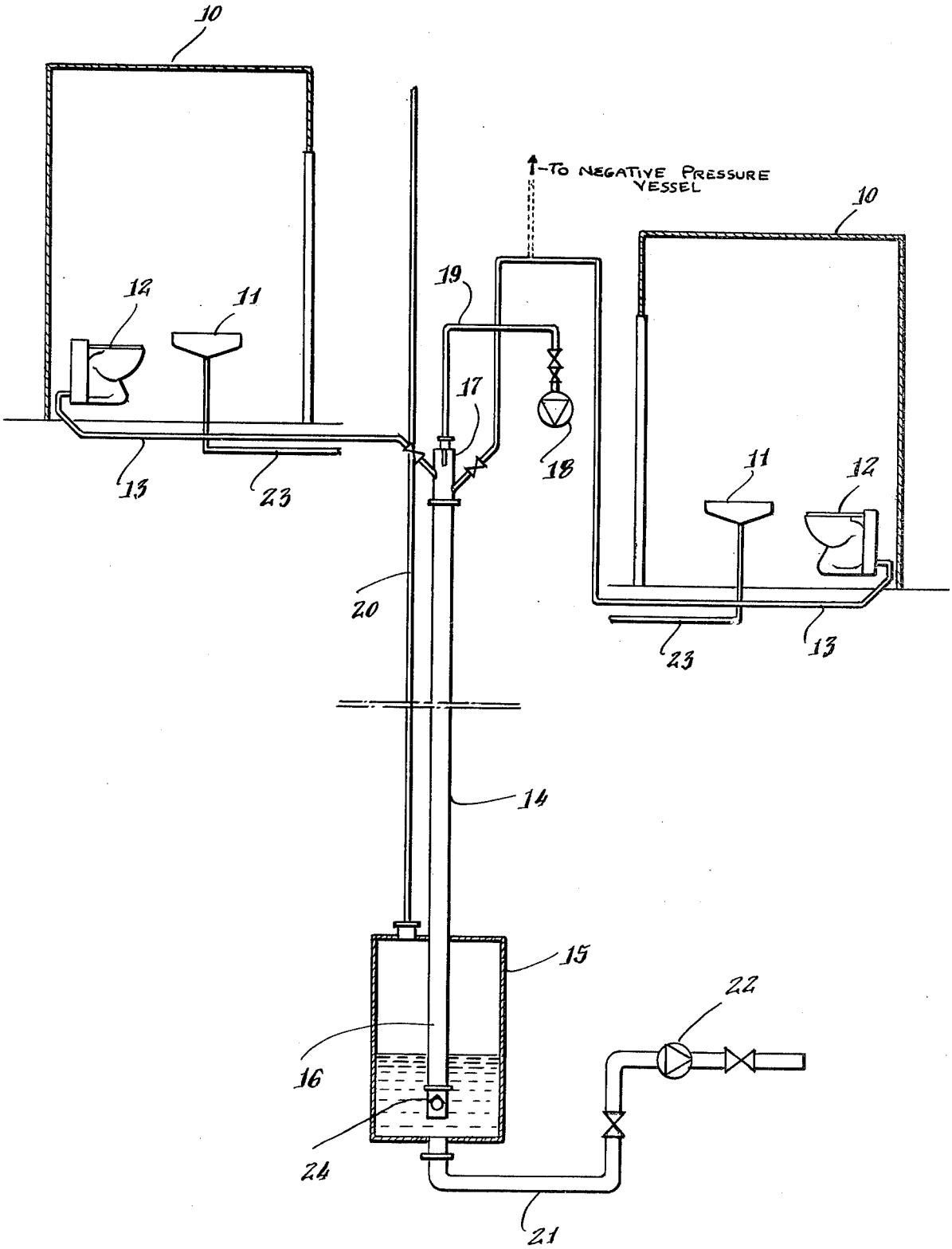
10
TO NEGATIVE PRESSURE VESSEL
10
12
11
19
17
18
11
12
13
23
20
23
13
14
15
22
16
24
21

WASTE WATER VACUUM CONVEYANCE METHOD AND APPARATUS

BACKGROUND OF THE INVENTION

Vacuum sanitary systems are known, and are used in many different connections in which conventional waste water systems are ineffective, or not workable. This is the case for example in ships, in which the vacuum sanitary system is widely used. One advantage of a vacuum system compared to a conventional system is that it is not necessary to lay the pipe system so as to enable a flow by gravity. Instead, in a vacuum system, it is an objective to lay the pipes so that water collecting parts, so-called pockets, are formed, which improve the transport of water. The system also permits waste water to be elevated to comparatively high levels through vertical pipe portions of the system. Another advantage is that the system can be built up of pipes of small dimensions, i.e. 50–100 mm, which facilitates assembling and laying of the piping. The so-called vacuum sanitary systems have been developed in the past by Sven Lilendahl who has been granted U.S. Pat. No. 3,239,849 issued Mar. 15, 1966, U.S. Pat. No. 3,181,553 issued May 4, 1965, U.S. Pat. No. 3,115,148 issued Dec. 24, 1963, U.S. Reissue Pat. No. 28,008 issued May 14, 1974 and U.S. Reissue Pat. No. 28,189 issued Oct. 8, 1974.

The known vacuum sanitary systems operate normally in accordance with some of the following three principles:

1. Waste, also called black water, from toilets and waste water, and so-called grey water, from other sanitary installations, are conveyed in separate systems and are collected in separate holding tanks.

2. Black water and grey water are conveyed in the same system and are collected in a common tank.

3. The black water is conveyed to a holding tank and the grey water is discharged by gravity directly to the ambient.

Common to the above methods in known systems is that they all require a collecting tank of a relatively large volume, in which at least the black water is collected. This tank is a pressure vessel which is under continual negative pressure by means of a vacuum pump. The volume of the tank is determined by specific requirement, but, as a rule, is about 3–6 $m^3$. The tank functions as both storage for the waste water, and vacuum reserve for the pipe system.

The conduit for incoming waste water is connected to the upper part of the tank and to the sanitary installations by way of a pipe system. The sanitary installations, i.e. toilets, washstands, kitchen sinks and the like, are connected to the pipe system by valves which normally prevent the entrance of air into the system.

In operation, upon flushing of a toilet, the relevant valve opens a connection between the pipe system and the toilet bowl, the difference between atmospheric pressure, acting on one side of the liquid mass in the toilet bowl, and negative pressure in the pipe system acting at the other side of the liquid mass, causes the waste water to enter into and be conveyed in the system in the form of a plug. The valve is so constructed and arranged as not to close the connection immediately after the plug has passed but permits a given quantity of air to flow in after the plug.

The valve for controlling the grey water is usually located adjacent to the lower part of a washstand, a floor drain, or the like, and operates generally in the same manner as the black water valve. It is also common to collect grey water from several sanitary installations to one and the same valve. Thus, water coming from a washstand, a floor drain or the like is collected in a housing having a float which, when the water has reached a given level, acts on the valve to open the connection between the float housing and the pipe system so that grey water is discharged in the form of a plug. In addition, a given quantity of air is admitted together with the plug, so that the plugs will be well separated.

With the foregoing arrangement waste water will be moved forwards in the pipe system in the form of plugs, separated by air. When the conveying distance is long, the plug breaks during the transport, and the air behind it can flow past and the propelling force diminishes. To promote reforming of the plug in such cases it is possible, as stated above, to lay the pipe system so that pockets are formed to which waste water flows by gravity. In these pockets the pipe portion is filled up by the water and permits air behind the plug again to act on the plug so as to move it forwards in the system.

When the waste water and the air reach the tank, the air is discharged by the vacuum pump and the liquid is collected in the bottom of the tank.

It should be pointed out that it is extremely important in the transport of both black water and grey water that the above separation of the plugs is accomplished, since otherwise there is the risk that a system is obtained in which the plugs coalesce and form a long continuous water column. Such a column can become so large that it will block the operation of the entire system.

It should also be pointed out that it has been previously described in the literature to use a vacuum system for grey water which includes a fall pipe to which grey water is conveyed from washstands and the like. This pipe contains a standing liquid column which provides the required negative pressure in the system. The sanitary installations for the grey water include a float by which water is directly proportioned into the system without the mixing of air therein. However, the transport distance must be relatively small for this system to operate. When the described system is used, grey water will be conveyed very slowly through the transport conduit to the fall pipe, which involves a great risk of sedimentation and clogging in the conduits. For the above reasons it would not be possible to use this type of system for transport of black water, and therefore this system has not been applied in practice.

As indicated above, the disadvantages of the sanitary systems hitherto built for the said purpose are that the reception or holding tank is designed to hold a considerable quantity of water and thus has become large and bulky. This, in turn, means that both the cost of the proper tank and the cost of installation have become relatively high.

In order to overcome the above-mentioned drawbacks the present invention proposes a transport system which does not require a large vacuum tank. For this purpose, the invention is characterized in that waste water is transferred from the sanitary installations to the pipe system during simultaneous supply of air, and that the pipe system includes a generally vertical, comparatively long pipe, which is closed at its upper end. Waste water and air are introduced into the upper part of the pipe in such a manner that air is separated from waste water and is removed by the aid of a vacuum pump, or the like, connected to the said upper part, and in that the waste water is collected in the form of a standing liquid column in the lower part of the vertical pipe and is successively caused to flow to the reception or holding tank. Air is prevented from entering through the lower part of the pipe by means of a water seal, or the like. A device for carrying out the method in accordance with the invention is generally characterized in that the system of conduits includes a generally vertical, comparatively long pipe, whose lower end by a water seal, or the like, communicates with the reception tank, in which the pressure is below atmospheric pressure, and whose upper part communicates with a device that generates negative pressure.

The invention will now be described more in detail with reference to the drawing in which the sole FIGURE shows diagrammatically a system constructed in accordance with the invention, and applied to a ship.

DESCRIPTION OF THE PREFERRED EMBODIMENT

The vacuum sanitary system, as seen in the drawing, are lavatories 10 with washstands 11, toilet bowls 12, and other sanitary installations. The toilet bowls are of vacuum type and are connected to conduits 13 opening into the upper part of a comparatively long pipe 14. This pipe can form a part of a system of conduits and can have the same diameter as the other pipes included in the system. The pipe 14 extends vertically upwards from a tank 15. When the system is used in a ship the tank can be a conventional holding tank, which means that the sacrifice for storage space will be very small. The lower end 16 of the pipe 14 is open whereas its upper end 17 is closed. The upper end of the pipe is connected to a vacuum pump 18 by way of a conduit 19. The vacuum pump maintains a negative pressure of 0.3–0.7 atmospheres in the upper part of the pipe, which results in the height of the liquid column in the pipe 14 being 3–7 m. The lower, open end of the pipe, is sunk into the liquid in the tank 15, and thus the liquid will form a liquid seal which prevents air from being drawn into the pipe. The upper part of the tank 15 communicates with atmosphere by way of a vent conduit 20. Thus, the tank 15 forms a storing space for black water and can be emptied by means of a conduit 21 and a pump 22, so that waste water can be transferred, for example, to a purification plant ashore. Of course, it is possible within the scope of the invention to transfer the waste to a purification plant on board the ship, which can be accomplished by permitting waste water to flow directly into the purification plant through an overflow outlet. Such an arrangement has, for example, the advantage that a comparatively continuous flow of waste water to the plant is obtained, which is contrary to systems in which waste water is transferred intermittently to the purification plant, with the aid of pumps.

In the illustrated system, grey water from washstands is conducted, without purification, directly to the ambient by way of the conduit 23, but it is possible, of course, to use a separate system for the grey water, or to mix the latter into the black water system.

The system, as shown, operates in the following manner:

Flushing of a toilet bowl 12 causes the relevant valve to open and the contents of the bowl to be forced into the system by atmospheric pressure. The valve is maintained in an open condition for a time sufficient for a given quantity of air to be sucked in after the liquid. Depending on the distance between the toilet bowl 12 and the vertical pipe 14, the liquid plug is conveyed directly to the vertical pipe 14, or stays in the system, and is conveyed to the pipe in steps in accordance with the water flushings. When the liquid has reached the vertical pipe 14, it flows down into it, and the air flows upwardly to be removed by the vacuum pump 18 in the upper part 17 of the pipe. When the height of the liquid column, due to the inflow of water, tends to increase, the result is that a quantity of liquid is discharged at the lower end 16 of the pipe into the tank 15, since the vacuum pipe tends to stabilize the height of the liquid column. The liquid flowing into the tank 15 will thus be stored in the tank until emptying is effected.

When many sanitary units are connected to the system it may occur that the vacuum supplied by the pump is not sufficient. In such case, a closed vessel can be provided which is placed in a desired location and is connected to the upper part of the vertical pipe 17 or to the pipe connection 19. Furthermore, in a vacuum system in a ship it is possible, in accordance with the present invention to prevent the liquid column in the pipe 14 to rise to the upper part 17 of the pipe and enter into the vacuum pump in the event that the ship should pitch rapidly downwards. The foregoing is achieved by placing a non-return valve 24 in the lower end 16 of the pipe. This valve, which for example can be a spherical float sealing against a conical portion of the lower end of the pipe, will thus open when waste water flows into the tank 15, but will prevent liquid from flowing up again in the pipe.

While particular embodiments of the invention are herein illustrated and described, it will be understood that changes may be made in the construction and arrangement of elements without departing from the spirit or scope of the invention. Therefore, without limitation in this respect, the invention is defined by the following claims.

What is claimed is:

1. A method of conveying waste water with the aid of a vacuum source from a plurality of sanitary installations through a system of conduits to a holding tank, or the like, comprising: transferring waste water in the form of a plug from said sanitary installations to said conduit system by operating a valve means during the simultaneous introduction of air into the system behind said plug, said conduit system including a relatively long pipe which is disposed generally vertically and is closed at its upper end, introducing said plug and air in the upper part of said pipe in such a manner that air is continuously separated from the waste water and removed by means of a vacuum pump, which applies a vacuum to the upper part of said vertical pipe, said waste water falling by gravity down said vertical pipe to be collected in the form of a standing liquid column in the lower part of said vertical pipe, said liquid column being of such a height that it is balanced by the vacuum prevailing in the upper part of said vertical pipe, said lower end of the vertical pipe being open and submerged within said holding tank, said standing liquid column being caused to flow to said holding tank, and a water seal in the lower part of said pipe preventing the entrance of air therein.

2. An apparatus for performing a method of conveying waste water with the aid of a vacuum source from a plurality of sanitary installations through a system of conduits to a reception tank, or the like comprising an elongated and generally vertically disposed pipe being part of said conduit system, said pipe being closed at its upper end and open at its lower end, a reception tank for said waste water maintained at atmospheric pressure, said lower end of said pipe being positioned within said reception tank and submerged in said waste water, a water seal, or the like, in the lower end of said pipe, said vacuum source comprising a device for generating negative pressure communicating with the upper end of said vertical pipe, valve means for permitting the transfer of said waste water from said sanitary installations to said conduit system during the simultaneous introduction of air into the system, and said device for generating negative pressure continuously removes said air from the system while said waste water is collected in the form of a standing liquid column in the lower part of said vertical pipe, said liquid column being of such a height as to be balanced by the vacuum prevailing in the upper end of said vertical pipe, said liquid column successively flowing into said reception tank.

3. An apparatus as claimed in claim 2 wherein said water seal is in the form of a non-return valve which prevents liquid from flowing back up said vertically disposed pipe.

* * * * *